US008220438B2

(12) United States Patent
Kaneda et al.

(10) Patent No.: US 8,220,438 B2
(45) Date of Patent: Jul. 17, 2012

(54) APPARATUS HAVING A CANISTER AND A COMPONENT ASSOCIATED WITH THE CANISTER

(75) Inventors: Yukihiro Kaneda, Komaki (JP); Tsuneyuki Kurata, Okazaki (JP); Masamitsu Hayakawa, Anjo (JP); Naohito Buseki, Obu (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 0 days.

(21) Appl. No.: 13/362,134

(22) Filed: Jan. 31, 2012

(65) Prior Publication Data

US 2012/0125200 A1 May 24, 2012

Related U.S. Application Data

(63) Continuation of application No. 12/588,782, filed on Oct. 28, 2009, now Pat. No. 8,151,768.

(30) Foreign Application Priority Data

Oct. 29, 2008 (JP) ..... 2008-278266

(51) Int. Cl.
*F02M 33/02* (2006.01)
*F02M 33/04* (2006.01)

(52) U.S. Cl. ..... 123/519

(58) Field of Classification Search ..... 123/519, 123/520, 516, 518, 198 D, 509; 137/587, 137/588, 589, 493
See application file for complete search history.

(56) References Cited

U.S. PATENT DOCUMENTS 5,987,968 A * 11/1999 Cook et al. ..... 73/49.7
6,311,675 B2 * 11/2001 Crary et al. ..... 123/516
6,886,583 B2 * 5/2005 Matsushima et al. ..... 137/270

* cited by examiner

*Primary Examiner* — Mahmoud Gimie
(74) *Attorney, Agent, or Firm* — Dennison, Schultz & MacDonald

(57) ABSTRACT

An apparatus including a canister and an accessory component associated with the canister. The canister may be filled with an adsorption material for adsorbing fuel vapor generated within a fuel tank. A communicating pipe extends downwardly from a housing of the accessory component for communication with the canister. An engaging protrusion is provided on an outer peripheral surface of the housing. An outer peripheral portion of an upper portion of the canister includes a wall portion for engagement with the engaging protrusion.

9 Claims, 6 Drawing Sheets

APPARATUS HAVING A CANISTER AND A COMPONENT ASSOCIATED WITH THE CANISTER

This application is a continuation of application Ser. No. 12/588,782, filed Oct. 28, 2009, which claims priority to Japanese patent application serial number 2008-278266, filed Oct. 29, 2008, the contents of both applications being incorporated herein by reference.

BACKGROUND OF THE INVENTION

1. Field of the Invention

The present invention relates to a device for mounting an accessory component on a canister so that the accessory component can communicate with the canister filled with an adsorption material for adsorbing fuel vapor generated within a fuel tank.

2. Description of the Related Art

A known device for mounting an accessory component on a canister is disclosed, for example, in Japanese Laid-Open Patent Publication 2006-308045. As shown in FIG. 6, a fuel vapor passage 101, a purge passage 104 and an atmospheric passage 106 are connected to a canister 100. The fuel vapor passage 101 introduces fuel vapor produced within a fuel tank T into the canister 100. The purge passage 104 is connected to an intake air passage 103 of an engine. The atmospheric passage 106 is opened into the atmosphere. An electromagnetic valve 107 is provided in the purge passage 104. The electromagnetic valve 107 closes the purge passage 104 when the engine is not operating. The electromagnetic valve 107 opens when the engine is operating. The electromagnetic valve 107 is mounted with a bolt on a case of the canister 100 and is connected to a purge port 100*p* of the canister 100.

However, the known mounting device for mounting an accessory component, such as the electromagnetic valve 107, with bolts on the canister 100 requires troublesome tightening operations of bolts and a number of assembling steps. More specifically, if weight of the accessory component is heavy, it is necessary to increase the number of bolts to stably fix the accessory component to the canister. Accordingly, required assembling steps for mounting the accessory component may be increased.

Therefore, there is a need in the art for a mounting device that can stably fix an accessory component to a canister.

SUMMARY OF THE INVENTION

One aspect according to the present disclosure includes a first coupling device and a second coupling device. The first coupling device can mechanically coupling the canister and the accessory component to each other. The second coupling device can couple the canister and the accessory component to allow flow communication with each other. The second coupling device is operable in conjunction with the operation of the first coupling device.

DETAILED DESCRIPTION OF THE INVENTION

Figure 1:
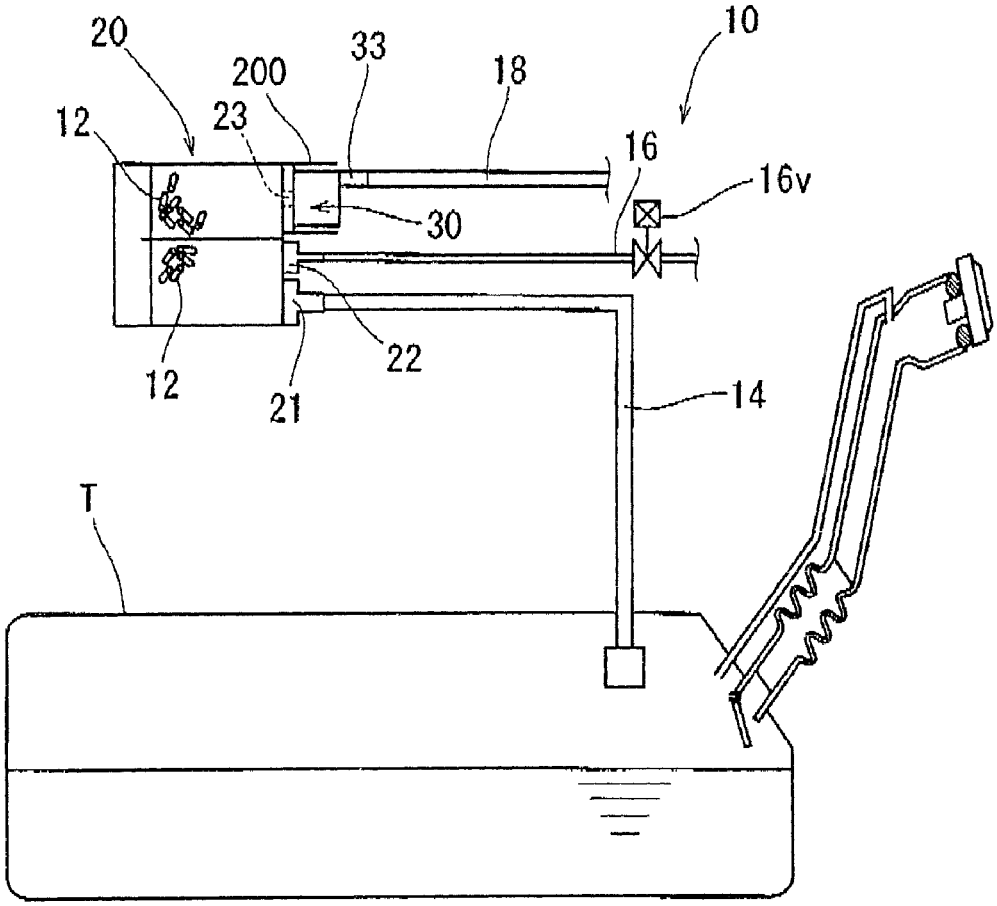
FIG. 1 is a schematic structural view showing a fuel vapor processing apparatus including a canister with an accessory component mounting device according to an embodiment of the present disclosure and a pump unit that is the accessory component of the canister.

Each of the additional features and teachings disclosed above and below may be utilized separately or in conjunction with other features and teachings to provide improved devices for mounting accessory components to canisters. Representative examples of the present disclosure, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a mounting device for mounting an accessory component to a canister may enable to communicate between the accessory component and the canister. The canister is filled with an adsorption material for adsorbing fuel vapor generated within a fuel tank. The mounting device includes a communicating pipe receiver and an outer wall provided on the canister. The communicating pipe receiver is connectible to a communicating pipe of the accessory component. The outer wall surrounds the communicating pipe receiver. The communicating pipe is connected to the communicating pipe receiver as a housing of the accessory component is fitted into the outer wall of the canister in an axial direction of the communicating pipe. An engagement mechanism is provided between the outer wall of the canister and the housing of the accessory component. The engaging mechanism can elastically engage the outer wall of the canister and the housing of the accessory component with each other and can fix the accessory component to the canister when the housing of the accessory component is fitted into the outer wall to reach a predetermined position.

According to this arrangement, the engagement mechanism is provided between the outer wall of the canister and the housing of the accessory component. As the housing is fitted into the outer wall of the canister by a predetermined depth, the engaging mechanism elastically engages to fix the accessory component to the canister. In addition, as the housing is fitted into the outer wall of the canister 20 by the predetermined depth, the communicating pipe of the accessory component is connected to the communicating pipe receiver of the canister.

In this way, the housing of the accessory component may be fixed to the canister by fitting the housing into the outer wall of the canister by a predetermined depth. Therefore, the number of steps required for assembling the accessory component to the canister may be reduced compared to that required for fixing the accessory component to the canister with bolts. Further, because the accessory component is fitted into the outer wall of the canister, the accessory component may be stably fixed to the canister even in the case that the weight of the accessory component is heavy.

In another embodiment, the accessory component mounting device may further include a projection formed on an outer peripheral surface of the housing of the accessory component and extending parallel to the axial direction of the communicating pipe and a concave formed on an inner peripheral surface of the outer wall of the canister and extending parallel to the axial direction of the communicating pipe. The concave is positioned to correspond to a position of the projection for engagement with the projection.

Therefore, by fitting the housing of the accessory component into the outer wall of the canister in such a way that the projection of the housing is aligned with the concave of the outer wall of the canister, it is possible to eliminate improper assembling.

The projection of the housing may be constituted by a port of the accessory component.

A plural number of linear protrusions may be formed on the outer peripheral surface of the housing of the accessory component. Outer end surfaces of the linear protrusions may contact with the inner peripheral surface of the outer wall of the canister. Due to these protrusions, shifting movement of the accessory component relative to the outer wall of the canister can be prevented.

(First Embodiment)

A device for mounting an accessory component on a canister according to a first embodiment of the present disclosure will now be described with reference to FIGS. 1 to 3, 4(A) to 4(D) and 5(A) to 5(E). The accessory component mounted to the canister in the present embodiment is a pump unit used for a leak check of the canister when an engine of an automobile is not operating.

<Fuel Vapor Processing Apparatus>

A fuel vapor processing apparatus 10 can prevent fuel vapor generated in a fuel tank T from leaking into the atmosphere. As shown in FIG. 1, the fuel vapor processing apparatus 10 includes a canister 20, a fuel vapor passage 14, a purge passage 16 and an atmospheric passage 18. The canister 20 is filled with a fuel adsorption material 12 for adsorbing fuel vapor. The fuel vapor passage 14 communicates the canister 20 with a space inside the fuel tank T. The purge passage 16 communicates between the canister 20 and an intake air passage (not shown) of the engine. The atmospheric passage 18 communicates between inside and outside of the canister 20.

As shown in FIG. 1, the fuel vapor passage 14 is connected to a tank port 21 of the canister 20. The purge passage 16 is connected to a purge port 22 of the canister 20. An electromagnetic valve 16*v* for opening and closing the purge passage 16 is provided in the midway of the purge passage 16. An atmospheric passage 18 is connected to an atmospheric port 23 of the canister 20 via a pump unit 30. The pump unit 30 is used for a leak check of the fuel vapor from the fuel vapor processing apparatus 10.

When the engine is not operating, the fuel vapor within the fuel tank T is introduced into the canister 20 via the fuel vapor passage 14 and can be adsorbed by the adsorption material 12. Because the electromagnetic valve 16*v* of the purge passage 16 is closed when the engine is not operating, the fuel vapor inside the canister 20 does not leak out into the intake air passage of the engine.

The electromagnetic valve 16*v* opens when the engine is operating and air inside the canister 20 is drawn into the intake air passage via the purge passage 16. Accordingly, air flows into the canister 20 via the atmospheric passage 18, the pump unit 30 and the atmospheric port 23, and then purges the fuel vapor adsorbed by the adsorption material 12. Thereafter, the purged fuel vapor and air are drawn into the intake air passage of the engine.

According to this device, the fuel vapor generated inside the fuel tank T can be prevented from leaking into the atmosphere. The leak check of the fuel vapor processing apparatus 10 is performed at a pre-determined timing when the engine is not operating. During the leak check, the pump unit 30 operates to eject the air inside the canister 20 to outside via the atmospheric passage 18. At that time, the inside pressures of the canister 20, the fuel vapor passage 14 and the purge chancel 16 become negative. The leak check for the fuel vapor processing apparatus 10 is performed by monitoring the negative pressure inside the canister 20 during a predetermined period of time.

<Pump Unit>

As shown in FIGS. 5(A) to 5(E), the pump unit 30 has a pump housing 31. A pump (not shown) and a motor (not show) to drive the pump are stored inside the pump housing 31.

The pump housing 31 is formed to have a substantially prismatic box-shaped configuration. A short communicating pipe 36 for connecting to the atmospheric port 23 of the canister 20 is formed on a bottom surface 31*d* of the pump housing 31 at a substantially central position of the bottom surface 31*d* and projects downwardly therefrom. As shown in FIGS. 5 (A) and (B), an outlet port 33 extending in the vertical direction (parallel to the axial direction of the short communicating pipe 36) is formed at a corner of the pump housing 31. A connector 35 is formed on an upper surface 31*u* of the pump housing 31 and extends upward therefrom. A cable connector (not shown) for the motor can be connected to the connector 35.

An outer peripheral surface of the pump housing 31 is constituted with a first peripheral surface 311, a second peripheral surface 312, a third peripheral surface 313, a fourth peripheral surface 314 and a concaved surface 315 formed between the second peripheral surface 312 and the third peripheral surface 313. The aforementioned outlet port 33 is positioned at a corner between the first peripheral surface 311 and the fourth peripheral surface 314.

A pair of vertical protrusions 31*t* extending linearly in the vertical direction respectively are formed on each of the first periphery surface 311, the third periphery surface 313 and the forth periphery surface 314. When the pump housing 31 is fitted into the canister 20 as will he explained later, the vertical protrusions 31 can be positioned within a space formed between the inner peripheral surface of an outer wall 200 (explained below) of the canister 20 and the outer peripheral surface of the pomp housing 31, so that the pump housing 31 can be prevented from shifting moving relative to the canister 20 in the radial direction. As shown in FIG. 5 (D), an inclined surface 31*k* is formed on the bottom end of the vertical protrusion 31*t* for preventing interference with the outer peripheral surface of the pump housing 31 during the fitting operation.

Figure 5A:
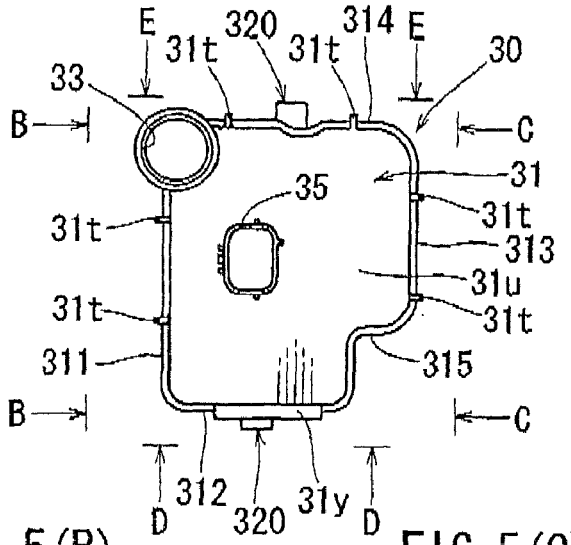
FIG. 5(A) shows a plan view of the pump unit.
Figure 5B:
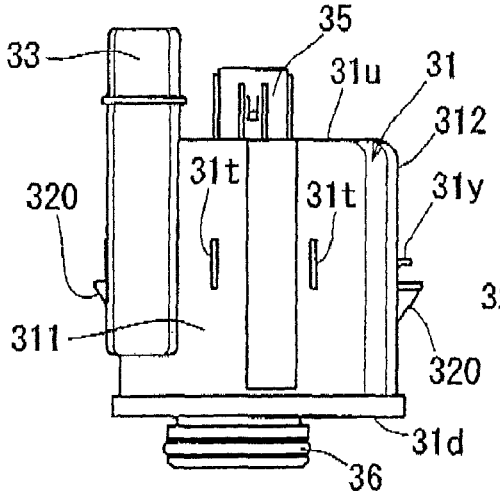
FIGS. 5(B), 5(C), 5(D), and 5(E) show side views of the pump unit.
Figure 5C:
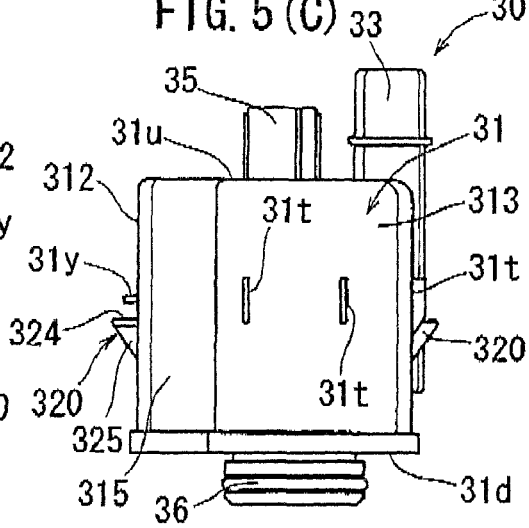
Figure 5D:
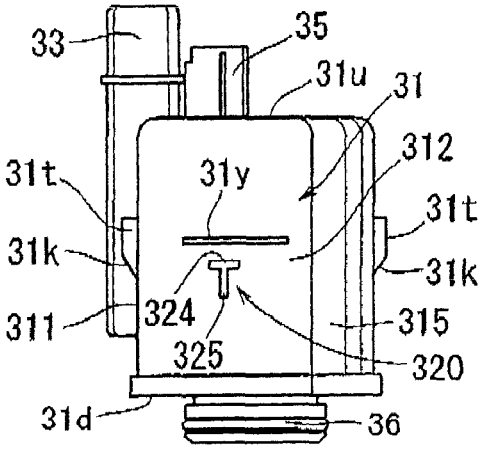
Figure 5E:
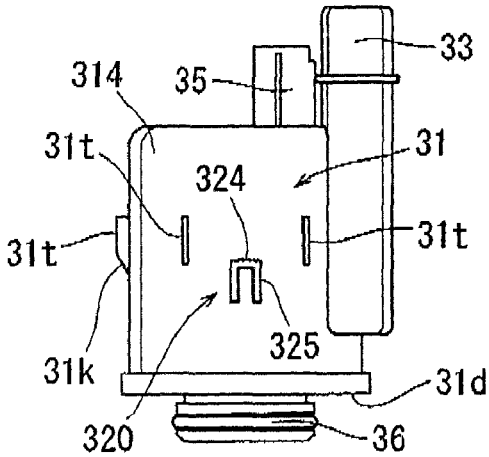
Figure 6:
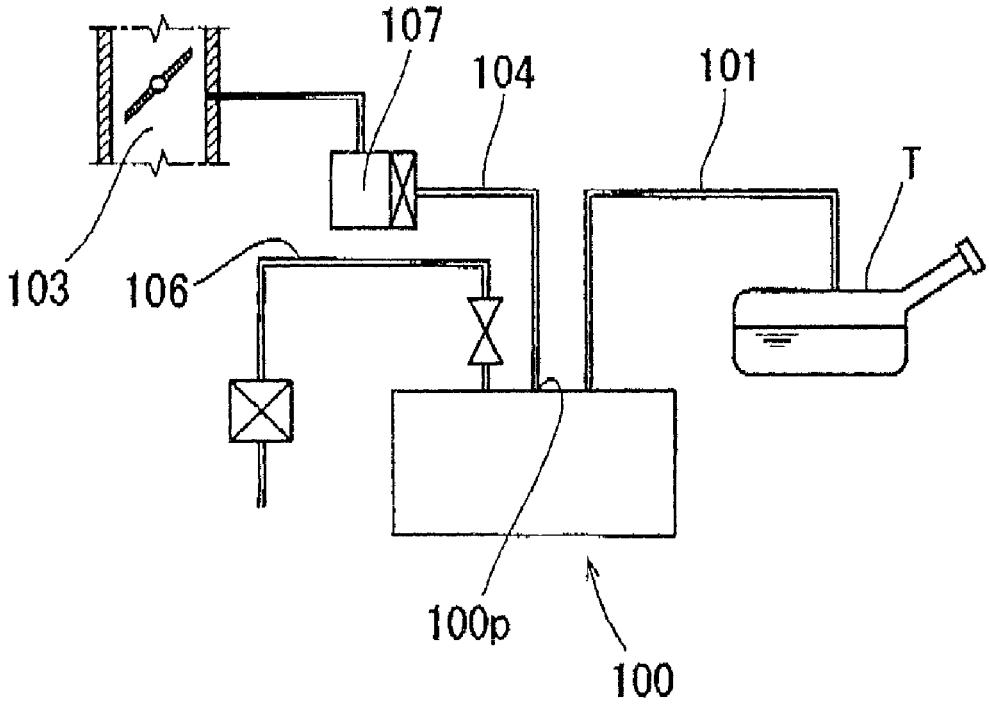
FIG. 6 PRIOR ART
FIG. 6 is a schematic structural view showing a known fuel vapor processing apparatus.

As shown in FIG. 5(D), a horizontal protrusion 31*y* extending in the horizontal direction is formed on the central portion of the second outer peripheral surface 312 of the pump housing 31. Similar to the vertical protrusions 31*t*, the horizontal protrusion 31*y* can be positioned within the space formed between the inner peripheral surface of the outer wall 200 of the canister 20 and the outer peripheral surface of the pump housing 31 in order to prevent the shifting movement of the pump housing 31.

A shelf-shaped engaging step portion 320 is formed on a substantially central portion of each of the second peripheral surface 312 and the fourth peripheral surface 314 of the pump housing 31. The engaging step portions 320 can engage with engaging openings 222 formed in the outer wall 200 of the canister 20. As shown in FIGS. 5(B)-5(E), each engaging step portion 320 has a flat plate-like main body 324 and a rib portion 325. The main body 324 projects at right angle from the corresponding outer peripheral surfaces 312 or 414. The rib portion 325 has a triangular configuration in a side view and supports the main body 324 from its lower side. The protruding distance of the engaging step portions 320 is set to be larger than the protruding distance of the vertical protrusions 31*t* and the horizontal protrusion 31*y*.

<Outer Wall of Canister >

The communicating short pipe 36 formed on the pump housing 31 may be inserted into and connected to the atmospheric port 23 (see FIG. 4 (B)) of the canister 20 so that the pump unit 30 can communicate with the canister 20. The atmospheric port 23 of the canister 20 serves as a communicating pipe receiver of the canister 20. The communicating short pipe 36 of the pump housing 31 corresponds to a communicating pipe of the accessory component.

Figure 3:
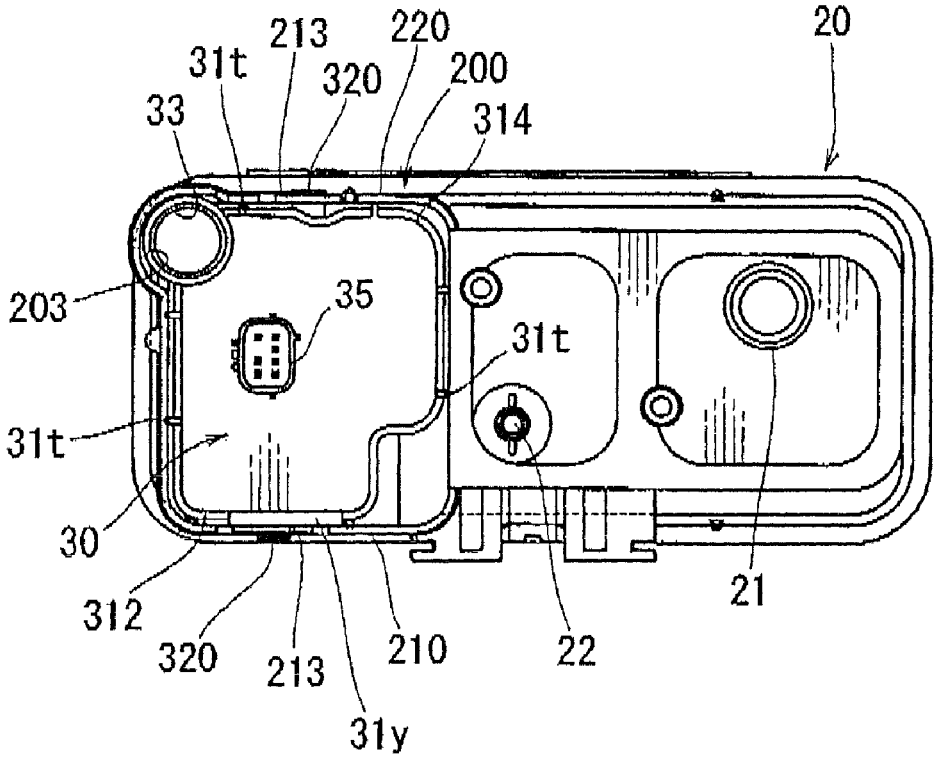
FIG. 3 is a front view of FIG. 2 as viewed from a direction identified with III-III arrows in FIG. 2.
Figure 4A:
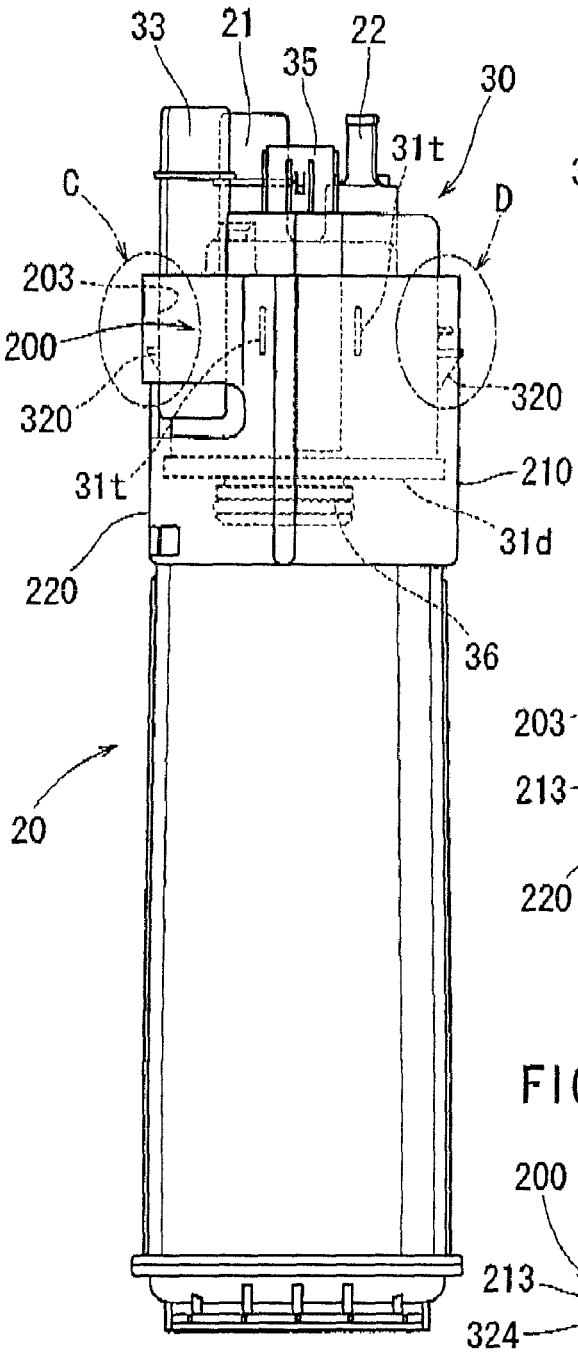
FIG. 4(A) shows a side view of FIG. 2 as viewed from a direction identified with IV-IV arrows in FIG. 2.
Figure 4B:
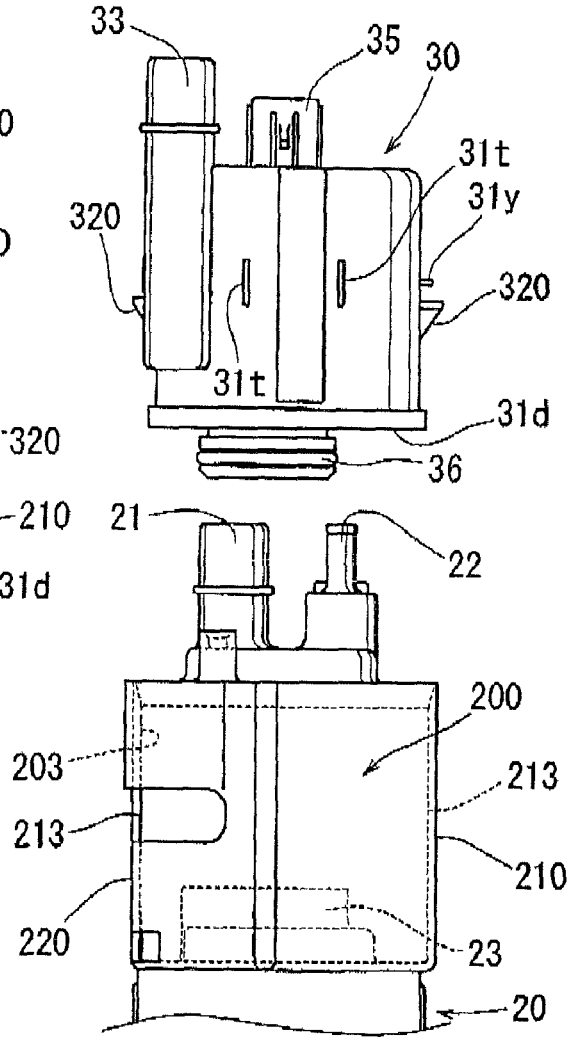
FIG. 4(B) shows a side view showing a mounting process of the pump unit to the canister.
Figure 4C:
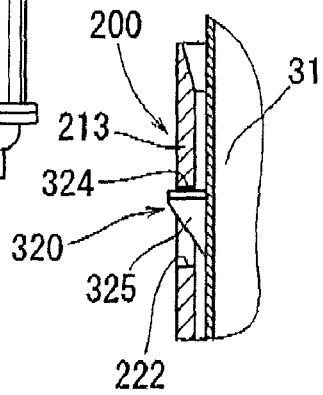
FIG. 4(C) shows a vertical sectional view of a portion C in FIG. 4(A)
Figure 4D:
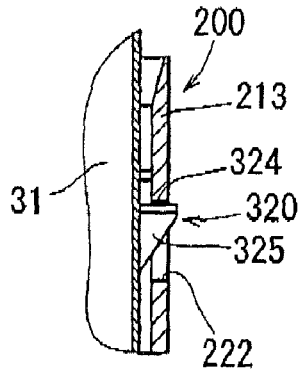
FIG. 4(D) shows a vertical sectional view of a portion D in FIG. 4(A)

As shown in FIGS. 3 and 4(A) to 4(D), the outer wall 200 is formed to surround the atmospheric port 23 of the canister 20. The pump housing 31 is fitted into the outer wall 200 as the communicating short pipe 36 of the pump housing 31 is inserted into and connected to the atmospheric port 23. As shown in FIG. 3, the outer wall 200 has a prismatic tubular shape substantially conforming to a shape in plan view of the pump housing 31. End surfaces (outer end surfaces in the protruding direction away from the pump housing 31) of the vertical protrusions 31*t* and the horizontal protrusion 31*y* of the pump housing 31 contact the inner peripheral surface of the outer wall 200 when the pump housing 31 is fitted into the outer wall 200 of the canister 20. On the outer wall 200, a groove-like concave 203 having a circular arc shaped cross section is formed at the corner corresponding to the outlet port 33 of the pump housing 31.

Figure 2:
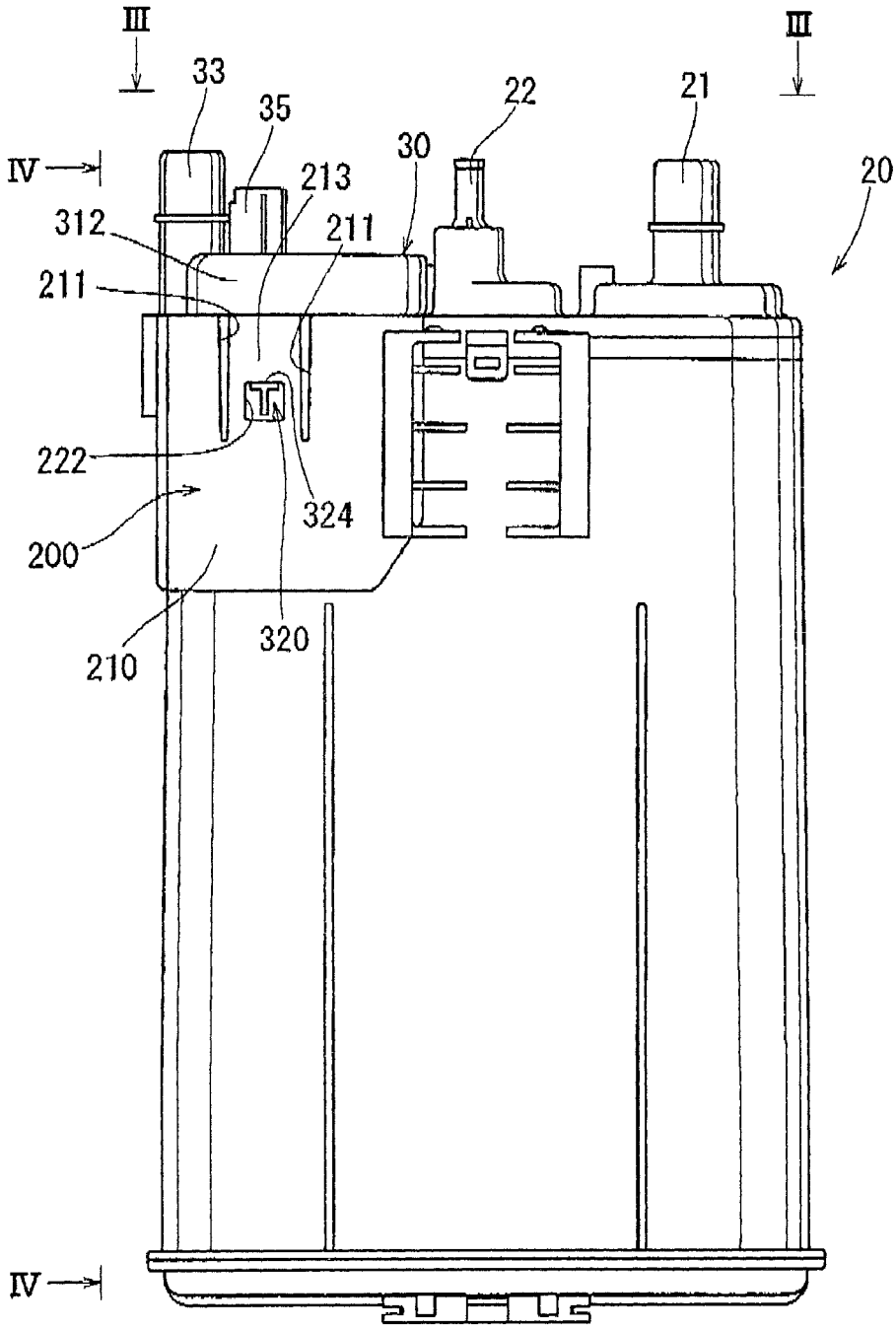
FIG. 2 is a plan view showing the canister to which the pump unit is mounted.

As shown in FIG. 2, a pair of slit-like cutouts 211 are formed on each of a front wall 210 corresponding to the second outer peripheral surface 312 and a back wall 220 corresponding to the fourth outer peripheral surface 314 of the pump housing 31 and extend from the central position of the top end of each of the walls 210 and 211 in the vertical direction (the downward direction in FIG. 2). More specifically, because of the pair of cutouts 211, a wall portion 213 located between the cutouts 211 is separated from the other wall portion in the circumferential direction. Because the outer wall 200 of the canister 20 is made of resin, the wall portions 213 arc elastically deformable in directions perpendicular to the front wall 210 and the back wall 220, respectively (directions perpendicular to the sheet surface of FIG. 2). The wails 213 will be hereinafter also called spring plate portions 213.

The engaging openings 222 for engaging the engaging step portions 320 of the pump housing 31 are formed at positions proximal to the base ends of the spring plates 213 and each has a substantially square configuration. The engaging openings 222 are positioned to be able to engage the engaging step portions 320 of the pump housing 31 when the pump housing 31 is fitted into the outer wall 200 and the communicating short pipe 36 is inserted into and connected with the atmospheric port 23.

<Assembling Operation of the Pump Unit to the Canister>

As shown in FIG. 4 (B), the assembling operation of the pump unit 30 to the canister 20 is performed by fitting the pump unit 30 into the outer wall 200 of the canister 20 while the pump unit 30 being moved in the axial direction of the communicating short pipe 36. For this operation, the position of the outlet port 33 of the pump unit 30 (the pump housing 31) is aligned with the position of the concave 203 of the outer wall 200 of the canister 20.

During the fitting process of the pump unit 30, the inclined surfaces 31*k* of the vertical protrusions 31*t* formed on the outer peripheral surfaces of the pump unit 30 (the pump housing 31) may first contact the inner side of the upper end of the outer wall 200 of the canister 20 and may then slide thereon. Due to this, the pump unit 30 can be positioned relative to the outer wall 200 of the canister 20 with respect to a radial direction of the communicating short pipe 36. As the fitting process of the pump unit 30 further proceeds, end surfaces (outer end surfaces) of the vertical protrusions 31*t* and the horizontal protrusion 31*y* formed on the outer peripheral surface of the pump unit 30 are brought to contact with the inner peripheral surface of the outer wall 200. Under this condition, the communicating short pipe 36 of the pump unit 30 and the atmospheric port 23 of the canister 20 are held to extend along the same axis.

Accordingly, it is possible to fit the pump unit 30 into the outer wall 200 of the canister 20 and concurrently to insert the communicating short pipe 36 of the pump unit 30 into the atmospheric port 23 of the canister 20 for connection therewith.

Further, during the fitting process of the pump unit 30, the ribs 325 of the engaging step portions 320 of the pump unit 30 push the spring plates 213 of the outer wall 200 of the canister 20 against the elastic force, so that the spring plates 213 are outwardly opened. When the communicating short pipe 36 of the pump unit 30 is inserted into the atmospheric port 23 of the canister 20 by a predetermined depth, the engaging step portions 320 of the pump unit 30 reach to the positions to be opposed to the engaging openings 222 of the spring plate 213 and then the spring plates 213 are returned back to the original positions due to the elastic force. Because of this, as shown in FIGS. 4 (C) and (D), the engaging step portions 320 of the pump unit 30 engage with the peripheral edges of the corresponding engaging openings 222 of the spring plate 213, and accordingly, the pump unit 30 is fixed to the outer wall 200 of the canister 20. In this way, the assembling process of the pump unit 30 to the canister 20 is completed.

The engaging step portions 320 of the pump unit 30 (the pump housing 31), the spring plates 213 formed on the outer wall 200 of the canister 20, and the engaging openings 222 constitute an engaging mechanism.

<Advantages of the Pump Unit Mounting Device of the Present Embodiment>

According to the pump unit mounting device of the first embodiment, the engagement mechanism (constituted by the engaging step portions 320, the spring plates 213, and the engaging openings 222) is provided between the outer wall 200 of the canister 20 and the pump housing 31 of the pump unit 30. As the pump unit 30 (the pump housing 31) is fitted into the outer wall 200 of the canister 20 by a predetermined depth, that the engaging mechanism elastically engages the pump unit 30 with the outer wall 200 and fixes the pump unit 30 to the canister 20. In addition, as the pump unit 30 is fitted into the outer wall 200 of the canister 20 by the predetermined depth, the communicating short pipe 36 is connected to the atmospheric port (a communicating pipe receiver) 23 of the canister 20.

In this way, the pump unit 30 may be fixed to the canister 20 by fitting the pump unit 30 into the outer wall 200 of the canister 20 by a predetermined depth, the number of steps required for assembling the pump unit 30 to the canister 20 may be reduced compared to that required for fixing the pump unit 30 to the canister 20 with bolts. Further, because the pump unit 30 is fitted into the outer wall 200 of the canister 20, the pump unit 30 may be stably fixed to the canister 20 even in the case that the weight of the pump unit 30 is heavy.

In addition, the outlet port 33 (a projection) extending in the axial direction of the communicating short pipe 36 is formed on the outer peripheral surface of the pump unit 30, and the concave 203 is formed on the inner periphery surface of the outer wall 200 of the canister 20 at a location corresponding to the outlet port 33 of the pump unit 30. Therefore, by fitting the pump unit 30 into the outer wall 200 of the canister 20 in such a way that the outlet port 33 of the pump unit 30 is aligned with the concave portion 203 of the outer wall 200 of the canister 20, it is possible to eliminate improper assembling.

Further, a plural number of protrusions 31*t* and 31*y* are formed on the outer peripheral surface of the pump unit 30 on opposite sides with respect to the center of the pump unit 30 and can contact the inner peripheral surface of the outer wall 200 of the canister 20. Accordingly, the protrusions 31*t* and 31*y* can prevent potential shifting movement of the pump unit 30 relative the outer wall 200 of the canister 20.

<Possible Modifications>

The present invention may not be limited to the above-described embodiment but may be modified in various ways. For example, the pump unit 30 is described as an example of accessory components of the canister 20 in the present embodiment. However, it is also possible to apply the present disclosure to a mechanism for mounting the electromagnetic valve 16*v* of the purge passage 16 to the purge port 22 of the canister 20. In such a case, the purge port 22 of the canister 20 corresponds to the communicating pipe receiver and the outer wall 200 is formed to surround the purge port 22. The present disclosure may also be applied to a mechanism for mounting an air filer to a corresponding port of the canister 20.

In the above embodiment, the engaging step portions 320 are formed on the pump unit 30, and the spring plates 213 and the engagement openings 222 are formed on the outer wall 200 of the canister 20. However, it is possible to form the spring plates 213 and the engagement openings 222 on the pump unit 30, and to form the engaging step portions 320 on the outer wall 200 of the canister 20.

Further, the vertical protrusions 31*t* and horizontal protrusion 31*y* are formed on the outer peripheral surface of the pump unit 30 in the above embodiment. However, the horizontal protrusion 31*y* may be replaced with vertical protrusion 31*t* so that all the protrusions are provided as the vertical protrusions 31*t*. Alternatively, the vertical protrusions 31*t* may be replaced with horizontal protrusions 31*y* so that all the protrusions are provided as the horizontal protrusions 31*y*.

The invention claims:

1. An apparatus comprising:

a canister filled with an adsorption material for adsorbing fuel vapor generated within a fuel tank; and an accessory component associated with the canister and including a housing having an upper surface, a lower surface and an outer peripheral surface;

a communicating pipe extending substantially vertically downward from the lower surface of the housing;

an engaging protrusion provided on the outer peripheral surface of the housing and protruding outwardly therefrom;

wherein the canister includes an upper portion and a wall portion, the upper portion having a communicating pipe receiver connectible with the communicating pipe, and the wall portion being provided on an outer peripheral portion of the upper portion; and wherein the wall portion includes an opening engageable with the engaging protrusion and opened in a direction substantially perpendicular to a connecting direction for connecting the communicating pipe with the communicating pipe receiver, so that the accessory component is prevented from moving in a direction opposite to the connecting direction when the engaging protrusion engages the opening.

2. The apparatus as in claim 1, wherein the wall portion of the canister is configured such that when the communicating pipe is connected to the communicating pipe receiver, the wall portion extends along the outer peripheral surface of the housing of the accessory component and the engaging protrusion engages the opening.

3. The apparatus as in claim 1, wherein the wall portion comprises a spring plate extending in a direction substantially parallel to the connecting direction and elastically deformable in the direction substantially perpendicular to the connecting direction.

4. The apparatus as in claim 1, wherein the wall portion is a substantially flat plate.

5. The apparatus as in claim 4, wherein the opening is formed to extend throughout the thickness of the flat plate.

6. The apparatus as in claim 1, wherein an engaging protrusion comprises a plurality of engaging projections provided on the outer peripheral surface of the housing, and the wall portion comprises a plurality of wall portions each having the opening for engaging corresponding one of the engaging projections.

7. An apparatus comprising:

a canister filled with an adsorption material for adsorbing fuel vapor generated within a fuel tank; and an accessory component associated with the canister and including a housing having an upper surface, a lower surface and an outer peripheral surface;

a communicating pipe extending substantially vertically downward from the lower surface of the housing;

a shelf-shaped engaging step portion provided on the outer peripheral surface of the housing and including a first portion projecting substantially horizontally outwardly from the outer peripheral surface of the housing and a second portion extending downwardly form the first portion and having an inclined surface inclined toward the outer peripheral surface of the housing in a direction substantially vertically downward;

wherein the canister includes an upper portion and a wall portion, the upper portion having a communicating pipe receiver connectible with the communicating pipe, and the wall portion being provided on an outer peripheral portion of the upper portion and having an opening engageable with the engaging step portion.

8. The apparatus as in claim 7, wherein the wall portion is a spring plate, so that when the accessory component is moved downwardly toward the canister in a connecting direction for connecting the communicating pipe with the communicating pipe receiver, the spring plate is pushed horizontally outwardly so as to be elastically deformed from an original configuration by the action of the second portion of the engaging step portion, and when the engaging step portion reaches a position opposed to the opening, the spring plate elastically recovers the original configuration to cause engagement of the opening with the engaging step portion.

9. An apparatus comprising:

a canister filled with an adsorption material for adsorbing fuel vapor generated within a fuel tank; and a pump unit associated with the canister and including a housing having an upper surface, a lower surface and an outer peripheral surface;

a communicating pipe extending substantially vertically downward from the lower surface of the housing;

a shelf-shaped engaging step portion provided on the outer peripheral surface of the housing and including a first portion projecting substantially horizontally outwardly from the outer peripheral surface of the housing and a second portion extending downwardly form the first portion and having an inclined surface inclined toward the outer peripheral surface of the housing in a direction substantially vertically downward;

wherein the canister includes and upper portion and a spring plate, the upper portion having a communicating pipe receiver connectible with the communicating pipe, and the spring plate being provided on an outer peripheral portion of the upper portion;

wherein the spring plate includes an opening, so that when the pump unit is moved downwardly toward the canister in a connecting direction for connecting the communicating pipe with the communicating pipe receiver, the spring plate is pushed horizontally outwardly so as to be elastically deformed from an original configuration by the action of the second portion of the engaging step portion, and when the engaging step portion reaches a position opposed to the opening, the spring plate elastically recovers the original configuration to cause engagement of the opening with the engaging step portion.

* * * * *